United States Patent [19]

Rodriguez-Cantos

[11] 3,985,206

[45] Oct. 12, 1976

[54] AUTOMATED SYSTEM FOR A DINING ROOM OR MESS

[76] Inventor: Delfos Rodriguez-Cantos, Santa Catalina, 12 -2° C, Majadahonda (Madrid), Spain

[22] Filed: May 30, 1975

[21] Appl. No.: 582,328

[30] Foreign Application Priority Data

Mar. 14, 1975 Spain ..... 435650

[52] U.S. Cl. ..... 186/1 R; 108/50; 312/268

[51] Int. Cl.[2] ..... E04H 3/04

[58] Field of Search ..... 186/1 R, 1 D; 108/50; 312/268; 134/124, 125; 198/230, 131, 140, 151, 152

[56] References Cited

UNITED STATES PATENTS

| | | | |
|---|---|---|---|
| 2,661,080 | 12/1953 | Xenakis | 186/1 R |
| 2,855,094 | 10/1958 | Zebarth | 198/230 |

*Primary Examiner*—Trygve M. Blix
*Assistant Examiner*—Reinhard J. Eisenzopf
*Attorney, Agent, or Firm*—Ladas, Parry, Von Gehr, Goldsmith & Deschamps

[57] ABSTRACT

An automated system for a dining room or mess comprises an endless belt which is entrained about rollers so that the belt has an upper horizontal run and a lower run situated below the upper horizontal run. An electric motor or the like is provided to drive the endless belt about the rollers. The belt is provided, on the upper surface of its upper run, with devices for securing sets of eating utensils to the upper surface, with the sets being spaced apart from one another along the upper run to define a plurality of eating positions. The system further comprises a plurality of seats adjacent to the upper run and spaced apart therealong to enable persons to eat from the upper run at the eating positions respectively. Thus, the upper run itself forms a table top. Washing apparatus is positioned beneath the upper run to wash the upper surface and eating utensils secured thereto when the electric motor has been operated to bring a portion of the upper run of the belt into the position of the lower run.

3 Claims, 5 Drawing Figures

AUTOMATED SYSTEM FOR A DINING ROOM OR MESS

The object of the invention for which a patent of invention is requested, as expressed in the title of this specification, refers to an automated system for a dining room or mess, the end purpose of which is to provide the market and the public in general with a process for the simultaneous distribution of meals to any number of table companions.

According to the law, dining rooms or messes are necessary in factories and firms employing a high number of employees, when the working day is not continuous. The distribution of meals presents in itself a series of problems, such as for example the need of various employees for this service and others for washing the dishes, the number whereof is high if there are various seating hours, etc.

All these problems are overcome by the automated system in question, since said system or procedure facilitates a rapid distribution of the meals as well as a reformation in the dining room or mess, within a short period of time, so that it can be re-used.

This system is based on the movement of an endless laminated band, constituting the panel of the table, which rests on and moves along rollers arranged on the structure of the table which is formed by the legs thereof and the longitudinal frames joining same. The outer or inner zones of the band comprise drums which serve to maintain it taut and to move it. The band can, thus, be displaced from the upper to the lower part, wherein means for cleaning the utensils which have been used during the meal, are found.

The endless band, constituting the panel of the table, is provided with suitable devices for supporting the plates and cutlery, which are attached and fixed by such devices for their direct washing when they are situated in the lower part corresponding to the washing chamber.

The table thus formed, is arranged on a floor or in the dining room or mess itself, at one end of which there is a space so that the staff can serve the dishes with their corresponding menu, when the endless band is in movement. The opposite zone or part is, likewise, provided with a space so that the band, during turning, can discharge all the remains of the food and can enter into the corresponding washing chamber, which is found immediately below the dining room or mess.

With this automated system or procedure, a service cycle can be completed in the minimum time possible, using very little labor and separating the activities for the carrying out of the mentioned cycle. Likewise, washing, drying and cleaning of the utensils are effected without the intervention of any attendance staff, assuring in this way a higher degree of hygiene and a control in cleaning.

Other advantages are: soiling of the dinner service is avoided because, as it is not moved from the table, breakage or deterioration thereof is impossible, inasmuch as cleaning thereof and removal of the remains are carried out automatically without the need of having to remove the utensils or dinner service from the fastening devices with which the endless band is povided.

Its application is mainly recommendable in factories and fixed military establishments where the rapid use of dining rooms or messes, for accomodating a large number of persons, in which the number of different dishes which can be served is limited, is necessary and advisable.

To compliment the description which will subsequently be made, and in order to have a better understanding of the characteristics of the invention, a set of drawings is attached to the present specification wherein the following is represented.

Figure 3:
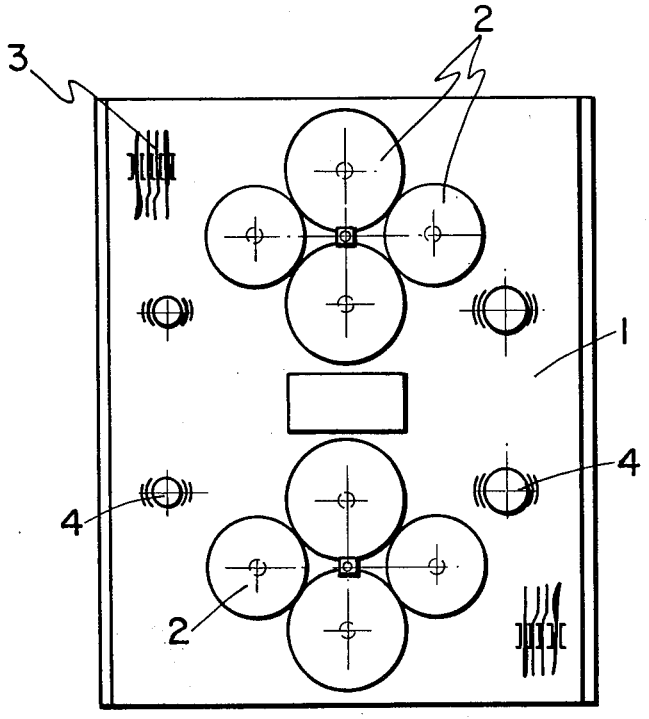
FIG. 3 represents an upper view of a part of the endless band together with the plates and forks arranged thereon.
Figure 4:
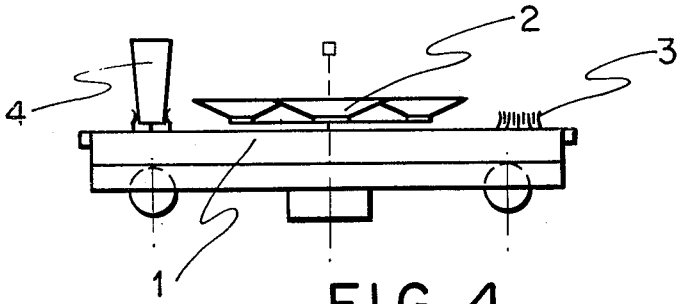
FIG. 4 represents an elevational view corresponding to FIG. 3.

These figures illustrates the movable part of the system constituted by an endless laminated band 1 which forms the continuous panel of the table, the length of which band 1 depends on the number of table companions. Plates 2, cutlery 3, glasses 4, etc., resting on the upper part of the band, are fixed and attached by conventional means, as can be seen in FIGS. 3 and 4.

Figure 1:
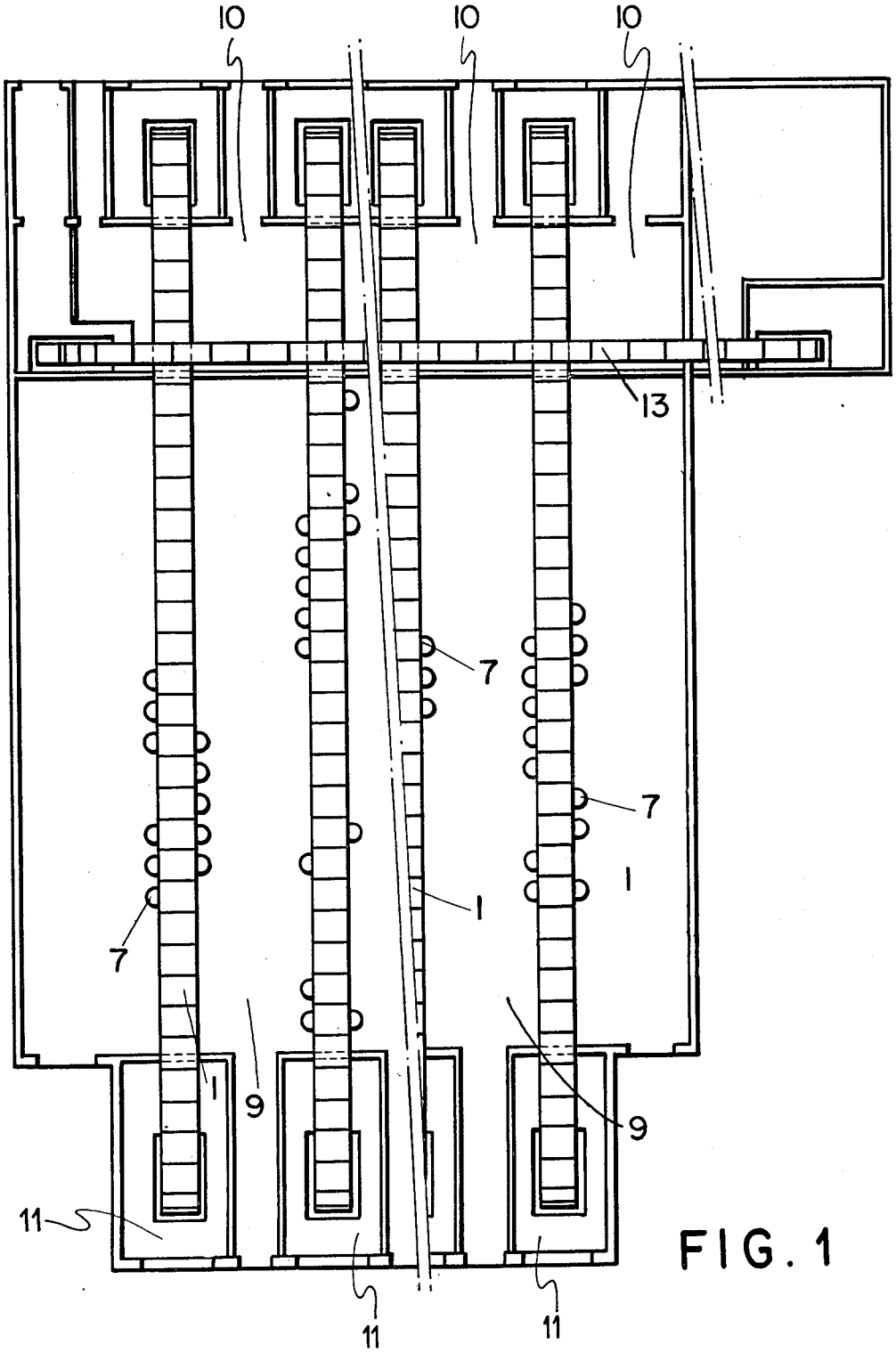
FIG. 1 represents a plan view of the automated dining room or mess.
Figure 2:
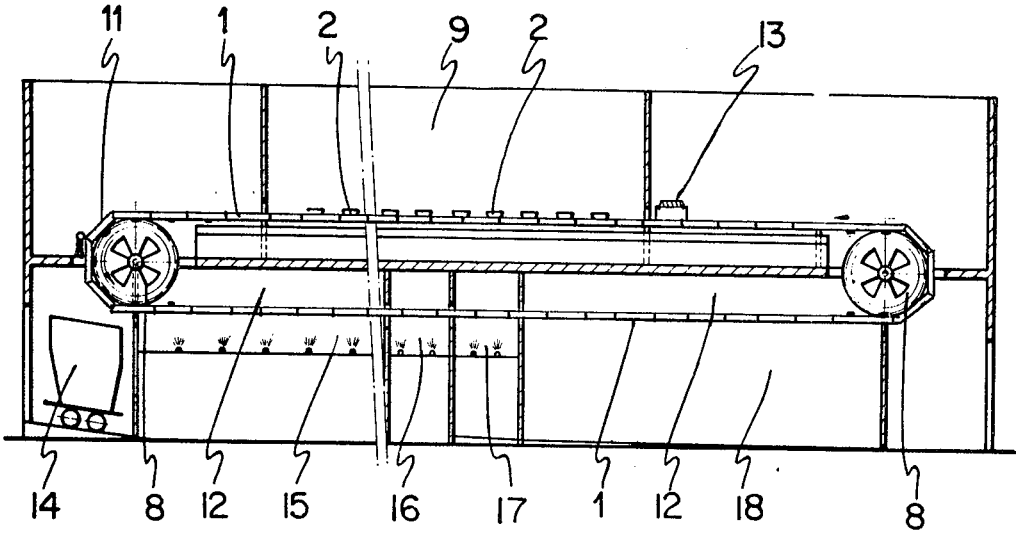
FIG. 2 represents a laterally sectioned, elevational view illustrating the mechanism which moves the endless band as well as the washing chamber.
Figure 5:
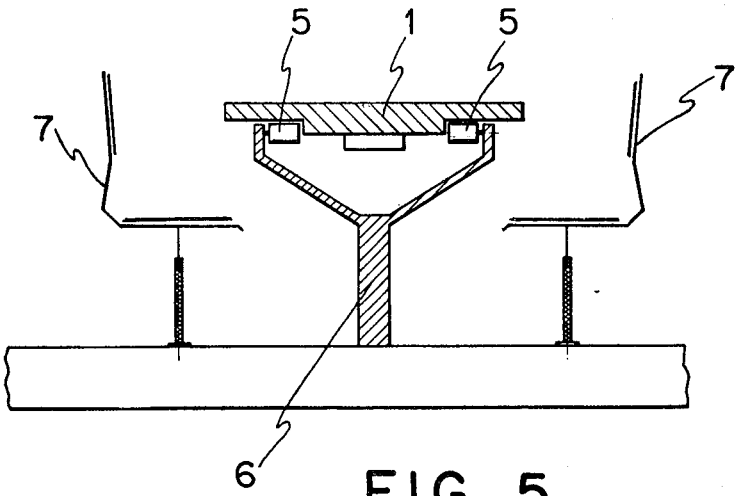
FIG. 5 represents a sectioned elevational view of how the endless band moves on rollers, the arrangement of the seats along the sides of the mentioned endless band can also be seen.

Band 1 moves on roller bearings 5 arranged on the structure of the table 6 which is formed and constituted conventionally, as can be seen in FIG. 5, in such a way that said table 6 and its structure are so adapted that the band 1 is arranged thereon and the respective seats are arranged along its sides.

At the ends of band 1 there are drums B which, besides being used for the movement of said band 1, maintain it taut. Said drums 8 are activated by means of a transmission system moved by an electric motor and by another device capable of transmitting movement to said drums 8, so that these haul the endless band 1 and move it from the upper part to the lower part situated below the site of the dining room or mess, where the apparatus for cleaning the corresponding dinner service used during the meals, is arranged.

On the other hand, there is a fixed unit constituting the dining room or mess 9 itself, one end of which is provided with a space 10 for the positioning of the food, while the opposite side is provided with another space 11 for the turning of the band 1 which is introduced into the lower zone 12, situated immediately below that of the dining room 9, which is divided into various sections and where cleaning of the table and the plates used takes place.

The process of the batches of food is continuous and we shall describe it from the end space 10, that is from where the dishes are served.

The staff in charge of serving the different menus is situated in the various spaces 10. In this way a transversal band 13 passes said spaces 10 containing the food coming from the kitchen. As this band 13 passes the different spaces 10, the staff distributes the desired menu in the different plates arranged on the upper part of the main endless band 1, placing on each individual table the dish requested by the consumer to whom a determined place should correspond in the dining room. While the dishes are being served, the band 1 is displaced at a suitable speed so as to permit the attendance staff to continue serving, without haste, the dishes ordered. Once serving in the dining room or mess has finished, the band is stopped so that the corresponding shift can eat.

Once the meal has terminated, the band 1 is again placed in motion, in such a way that the utensils used pass through the end opposite to that which has been used for serving, and are directed towards the lower zone 12 where the corresponding washing chambers are situated. As band 1 moves, the clean utensils coming from the lower zone appear on the upper part of the spaces 10 and they are ready to be used to serve another batch of menus. When this is served, the utensils corresponding to the prior shift will be found in the cleaning chambers of the lower zone 12, where they are, in turn, being prepared so as to be re-used.

Cleaning is carried out as follows: When the band 1 is rotated on the end drum 8, the remains fall into the corresponding tank 14 which can be withdrawn when full. Movement continues, and since the dinner service is fixed to the band; it passes therewith to the washing chamber 15 where washing takes place with hot water under pressure, passing in its continuous movement to a second chamber 16 filled with chlorinated water, and subsequently to a rinsing chamber 17, passing therefrom to a final chamber 18 where drying under hot air is effected. Thus, the band together with the dinner service completely clean and ready to be used, as already described in the prior shift, reaches the end drum 8 with which the upper part of band 1 is provided.

To obtain the automatic process of the dining room or mess, the dinner service should be joined to the band 1 conventionally and in a safe manner besides, in its fixed arrangement, being incorporated to devices which can turn on the studs on which they are mounted, so that the table companion can arrange the dish which he desires in the convenient position, as can be seen in FIGS. 3 and 4. Glasses 4 have, likewise, a special shape which permits them to be fixed to the band 1 and the cutlery 3 is likewise joined, by fixing elements, which permit them to pass through the cleaning chambers without becoming unfastened. They are, however, duly cleaned for their re-use.

As can be seen from the description made, the invention consists in the continuous movement of an endless band 1 which is activated conventionally. Said band has, at its ends, zones or spaces from which the food is served and the remains is discharged respectively, cleaning taking place in a lower part conveniently provided for such purposes.

The advantages derived from this automated dining room or mess are innumerable, since a large number of table companions can be served more rapidly, in very reduced periods of time and with a minimum of attendance staff.

washing, drying and cleaning of the utensils of the dining room or mess are effected without the intervention of any personnel whatsoever, thus maintaining a high degree of hygiene and a control in cleaning.

Soiling of the dinner service is avoided, since the tables are not moved. Withdrawal of the remains is carried out mechanically, without the need of attendance staff.

I claim:

1. An automated system for a dining room or mess, comprising an endless belt which is entrained about rollers so that the belt has an upper horizontal run which forms a table top and a lower run situated below the upper horizontal run, and drive means to drive said endless belt about the rollers, said belt being provided, on the upper surface of its upper run, with means for securing a plurality of sets of eating utensils to said upper surface with the sets spaced apart from one another along the upper run to define a plurality of eating positions, and the system further comprising seating means providing a plurality of seats adjacent to said upper run and spaced apart therealong to enable a plurality of persons to eat from said table top at said plurality of eating positions respectively, and washing means positioned beneath the upper run to wash said upper surface and eating utensils secured thereto when the drive means have been operated to bring a portion of the upper run of the belt into the position of the lower run.

2. A system as claimed in claim 1, wherein the means for securing the eating utensils to said upper surface include means for securing a plurality of plates to said upper surface at said eating positions respectively, so that persons eating at the eating positions can eat from said plates without removing said plates from the securing means.

3. A system as claimed in claim 1, having a serving zone at one end of the upper run and a scrap-removal zone at the opposite end of the upper run, and further comprising a removable container positioned in the scrap-removal zone to receive scraps which fall from the belt when the drive means are operated to bring a portion of the upper run of the belt into the position of the lower run, and a second endless belt extending transversely of the first-mentioned endless belt in the region of said serving zone for transporting food from a food-preparation zone to said serving zone at which food is transferred from said second endless belt to utensils secured to said upper surface of the first-mentioned endless belt.

* * * * *